US010889953B1

(12) United States Patent
Buse

(10) Patent No.: US 10,889,953 B1
(45) Date of Patent: Jan. 12, 2021

(54) DRILL STAKE AND ACCESSORIES FOR CONCRETE FORM CONSTRUCTION

(71) Applicant: Jay R. Buse, Oregon City, OR (US)

(72) Inventor: Jay R. Buse, Oregon City, OR (US)

(73) Assignee: IDIZ Limited, Condon, OR (US)

( * ) Notice: Subject to any disclaimer, the term of this patent is extended or adjusted under 35 U.S.C. 154(b) by 0 days.

(21) Appl. No.: 16/826,192

(22) Filed: Mar. 21, 2020

(51) Int. Cl.
*E02D 5/80* (2006.01)
*E02D 5/76* (2006.01)
*E04G 17/02* (2006.01)
*E04G 11/08* (2006.01)

(52) U.S. Cl.
CPC ..... *E02D 5/801* (2013.01); *E02D 5/765* (2013.01); *E04G 11/087* (2013.01); *E04G 17/02* (2013.01); *E02D 2200/165* (2013.01); *E02D 2200/1607* (2013.01)

(58) Field of Classification Search
CPC ... E02D 5/801; E02D 5/765; E02D 2200/165; E02D 2200/1607; E04G 17/02; E04G 11/087; E04H 12/2223; E04H 12/2215
USPC ..... 52/155–159
See application file for complete search history.

(56) References Cited

U.S. PATENT DOCUMENTS 2,603,319 A * 7/1952 Dyche ..... E02D 5/801 52/157
4,239,419 A * 12/1980 Gillen, Jr. ..... E02D 5/523 405/232
4,503,920 A * 3/1985 Clement ..... B23B 51/02 175/394
4,642,012 A * 2/1987 Blucher ..... E04D 3/3603 411/383
4,763,456 A * 8/1988 Giannuzzi ..... E04D 3/3603 411/133
5,069,589 A * 12/1991 Lemke ..... E04D 5/145 411/533
5,240,353 A * 8/1993 Bower ..... B63B 21/26 405/259.1
5,358,209 A * 10/1994 Ward ..... E04H 12/2223 248/530
5,575,593 A * 11/1996 Raaf ..... E02D 5/30 405/232
5,919,005 A * 7/1999 Rupiper ..... B09C 1/00 175/323
5,975,808 A * 11/1999 Fujita ..... E02D 5/28 405/244
6,032,880 A * 3/2000 Verrills ..... E04H 12/2223 248/156
6,820,379 B1 * 11/2004 Krinner ..... E04H 12/2223 108/156
7,384,223 B2 * 6/2008 Nadler ..... B23B 49/005 175/385
7,950,200 B2 * 5/2011 Tropiano ..... E02D 5/74 52/745.21
8,308,117 B2 * 11/2012 Braun ..... A47G 25/0635 248/231.91

(Continued)

*Primary Examiner* — Paola Agudelo
*Assistant Examiner* — Adam G Barlow
(74) *Attorney, Agent, or Firm* — Mersenne Law

(57) ABSTRACT

Embodiments of the invention are stakes for securing concrete-casting forms to the ground (e.g., compacted earth and compacted gravel surfaces), which can be inserted and removed easily by using an impact drill or hammer drill. Modular concrete casting forms and other accessories are also described and claimed.

20 Claims, 8 Drawing Sheets

(56) References Cited

U.S. PATENT DOCUMENTS 8,631,629 B1 * 1/2014 Wiener ..... E04D 13/1476 52/745.21
8,683,756 B2 * 4/2014 Schoetz ..... E02D 5/801 52/157
8,753,056 B2 * 6/2014 Gstach ..... F16B 25/0084 411/387.4
D877,486 S * 3/2020 Chen ..... D3/10
2004/0163336 A1 * 8/2004 Hsu ..... E04H 12/2223 52/157
2006/0060749 A1 * 3/2006 Dahlstrom ..... A45F 3/44 248/545
2006/0236620 A1 * 10/2006 Lacrosse ..... E02D 5/805 52/155
2008/0008555 A1 * 1/2008 Ardern ..... E04H 12/2223 411/411
2010/0183378 A1 * 7/2010 Goto ..... E02D 5/801 405/253
2011/0277743 A1 * 11/2011 Almy ..... F24S 25/12 126/569
2011/0314749 A1 * 12/2011 Rainer ..... E02D 5/801 52/157
2012/0036797 A1 * 2/2012 Ardern ..... E04H 12/2223 52/157
2012/0153099 A1 * 6/2012 Wesolik ..... F16M 9/00 248/156
2013/0108374 A1 * 5/2013 Okobi ..... E04H 12/2269 405/259.1
2013/0111828 A1 * 5/2013 Lymberis ..... E02D 5/803 52/155
2015/0114053 A1 * 4/2015 Staller ..... E02D 5/80 70/165
2015/0191886 A1 * 7/2015 Okobi ..... E02D 5/801 52/157
2018/0030681 A1 * 2/2018 Stroyer ..... E02D 5/52
2019/0338549 A1 * 11/2019 McDermott ..... F16M 11/245

* cited by examiner

DRILL STAKE AND ACCESSORIES FOR CONCRETE FORM CONSTRUCTION

CONTINUITY AND CLAIM OF PRIORITY

This is an original U.S. patent application.

FIELD

The invention relates to concrete construction tools. More specifically, the invention relates to stakes, forms and associated equipment for quickly configuring forms to constrain cast-in-place concrete structures.

BACKGROUND

Concrete is a common building material comprising aggregate (particulate material such as sand, gravel, crushed stone, slag and other materials) bonded together with a fluid cement such as Portland cement. Concrete structures are often constructed by mixing aggregate and Portland cement with water to form a viscous slurry, then pouring the slurry into a wooden form that holds the slurry in the desired shape until the cement cures. The form is then removed, leaving the concrete shape.

Residential and commercial buildings are often constructed atop a concrete foundation formed as described above. The construction of the form before pouring the concrete slurry and removal of the form after curing is a time-consuming task. Tools and processes that reduce the time and effort involved in form building and removal may be of substantial value in this field.

SUMMARY

Embodiments of the invention are stakes for securing form pieces to the earth, and standardized form pieces that can be assembled and disassembled quickly to make forms for pouring foundations and walls.

DETAILED DESCRIPTION

Embodiments of the invention comprise a number of novel apparatuses, which can be combined with known devices and techniques to improve workers' efficiency and productivity at constructing forms for casting concrete structures in place (e.g., for pouring foundations, retaining walls, fences and the like).

Figure 1:
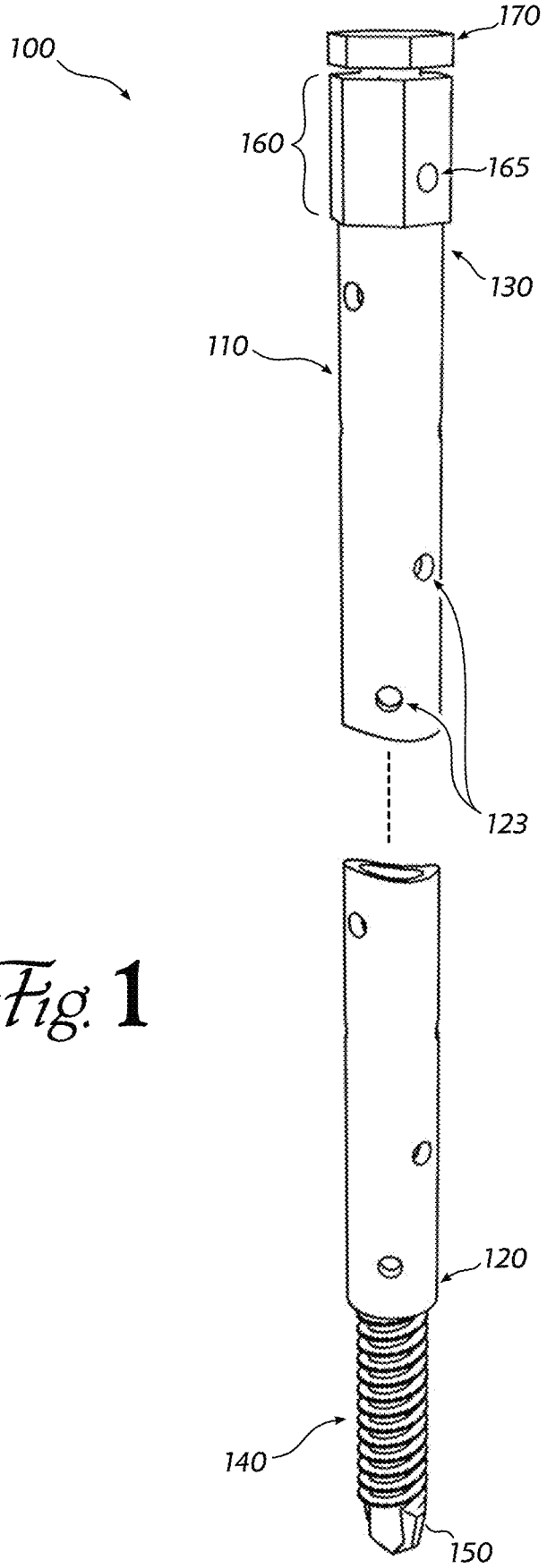
FIG. 1 shows a drill stake according to an embodiment of the invention.

FIG. 1 shows a drill stake 100, which is an important element of the inventive system. The drill stake comprises a tubular body 110 having a lower end 120 and an upper end 130. Tubular body 110 may be made of steel tubing having a suitable wall thickness, strength and surface treatment for the application. The body may be, for example, between about 2' and about 6' in length. (It will be apparent that shorter or longer body lengths are also possible, and may be preferable in certain applications.) A plurality of holes 123 are formed through the body, perpendicular to the lengthwise axis of the tube and at varying angles when viewed end-on.

A helical drill structure 140, like a concrete drill, is coupled to the bottom end 120 of the tubular body. The central axes of the drill 140 and the tubular body 110 should be coincident. Helical- or concrete-drill 140 comprises a plurality of tough cutters, one of which is visible at 150 in this Figure. These cutters may be, for example, tungsten carbide or silicon nitride.

A threaded coupler 160 is secured to the upper end 130 of the tubular body 110. In the embodiment depicted here, coupler 160 is a hexagonal prism shape, but other polygonal prisms, such as square, pentagonal, or even star-shaped, may be used (provided the shape matches the receptacle of the impact socket described below). One or more faces of the threaded coupler may have hemispherical divots 165 formed therein. These divots, if present, may help secure the drill stake in the impact socket. The coupler has a threaded hole formed through it so that the interior of tubular body 110 can be accessed from the upper end of the drill stake. (The threaded hole is not visible in this Figure.)

Finally, the drill stake 100 has a threaded bolt 170 inserted into the threaded hole of the coupler. The head of the threaded bolt should have the same polygonal profile as the coupler—a hexagon is shown here, but a four- or five-sided bolt head, or a star ("Torx") head may be used as well. The threaded bolt 170 is preferably of a tougher material than the coupler; it bears the brunt of the impact hammer during setting, and can be removed and replaced if it becomes damaged. Furthermore, when the bolt is removed, the interior of the drill stake (inside the tube) is exposed, and dried cement and other debris can be removed easily. A metal dowel can be used as a ramrod inside the body tube to break up concrete that has managed to enter the tube through the holes 123.

The drill stake shown in FIG. 1 can be driven into the ground quickly and easily, even into compacted earth or gravel, by using an impact hammer. Furthermore, modern impact hammers can be operated in reverse, and in that mode, removal of an inventive drill stake is also quick and low-effort. (For removal, it is helpful to pin the stake to the socket so that the impact drill will not be inadvertently pulled off the stake while extracting it.)

A satisfactory drill stake according to an embodiment may be constructed of common, off-the-shelf parts, including a concrete drill bit, a length of Schedule 80 pipe and an appropriately-sized threaded coupler, all of which may be welded together in the arrangement depicted. Schedule 80 pipe is about 13/16" outer diameter, 9/16" inner diameter (1/8" wall thickness). 3/4" tube steel (1/2" ID, 1/8" wall thickness) is also suitable, but more expensive. The drill bit is preferably slightly smaller than the steel tube outer diameter, and the threaded coupler is preferably slightly larger. However, for some applications (e.g. depending on the soil or gravel where the drill stake is used) the drill bit may be larger than the steel tube outer diameter, and when a larger outer-diameter steel tube is used, a smaller threaded coupler may be preferred so that the same impact socket can be used with all stakes.)

Figure 2:
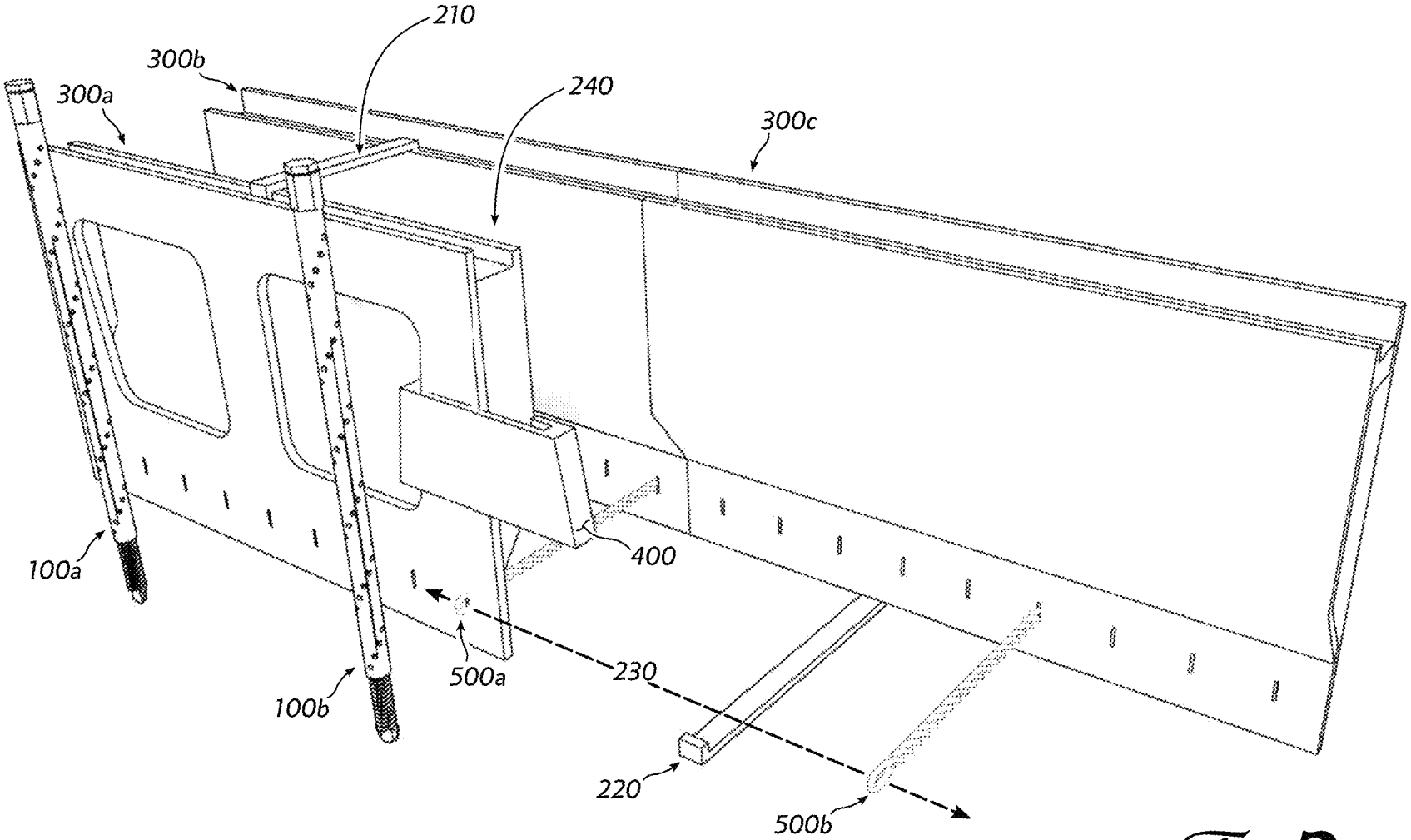
FIG. 2 shows many of the components of the inventive construction system.

FIG. 2 shows an arrangement of many of the components of the inventive system. The individual components are depicted in FIGS. 3-5, so those Figures will be described before FIG. 2.

Figure 3:
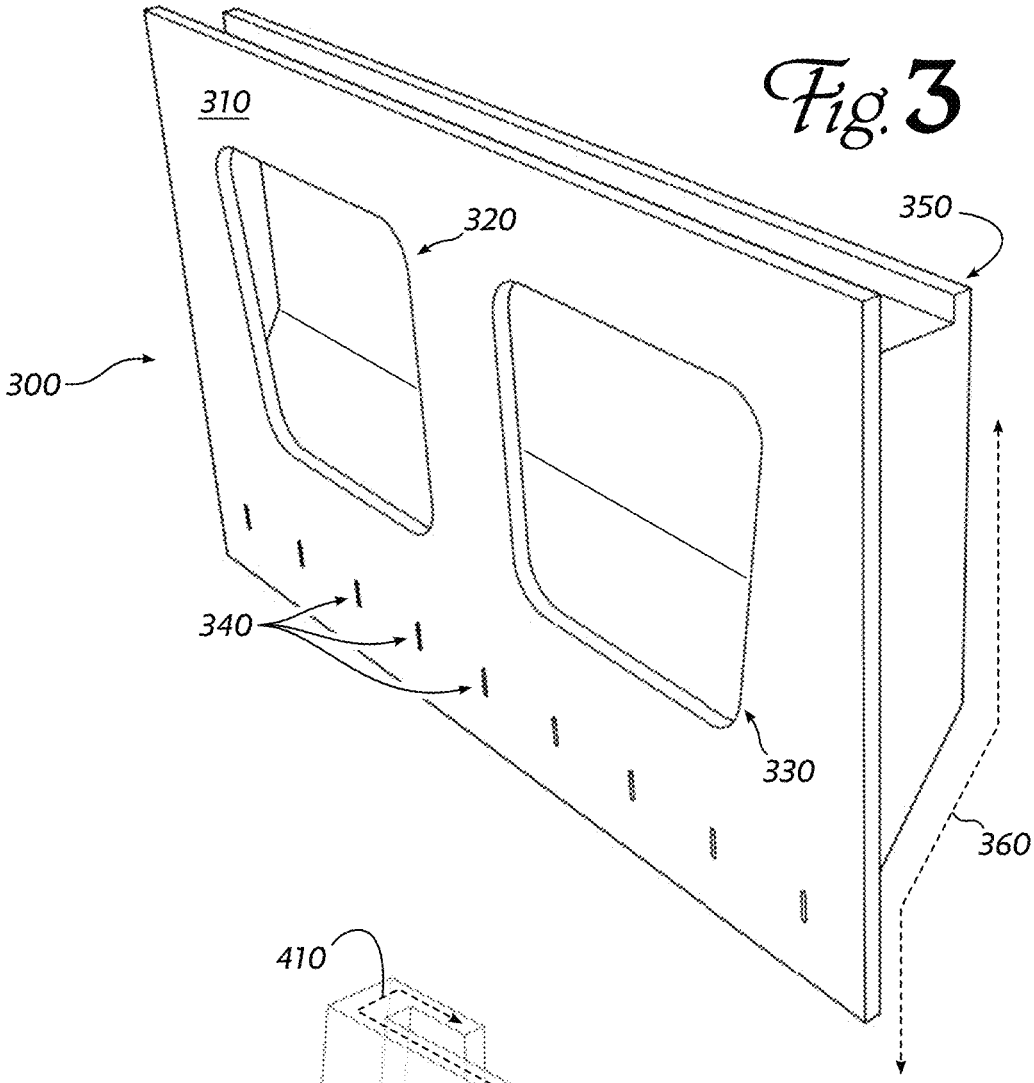
FIG. 3 shows a common form segment.

FIG. 3 shows one "common form" segment 300—so-called because the form is suitable for constructing a thicker footing with a thinner stem wall atop it, in a single concrete pour (a "mono-pour"). The outer surface 310 of the common form has two openings 320, 330, and a plurality of narrow slots 340 near the bottom edge. It should be appreciated that a longer common form may have more openings in its outer surface, while a shorter common form may have only one, or even none. The rear or inner surface 350 is not visible in this view, but it is a smooth surface to reduce adherence to the cured concrete poured into the form. The inner surface 350 has a discontinuity as shown at 360 so that the lower portion of the wall is thicker or wider than the upper portion of the wall. The inner and outer faces of a common-form segment may be made of plywood, for example, ¾" thick plywood. The edges may be made from suitable dimensional lumber, such as 2×4 (actual dimensions approximately 1¾"×3½").

Figure 4:
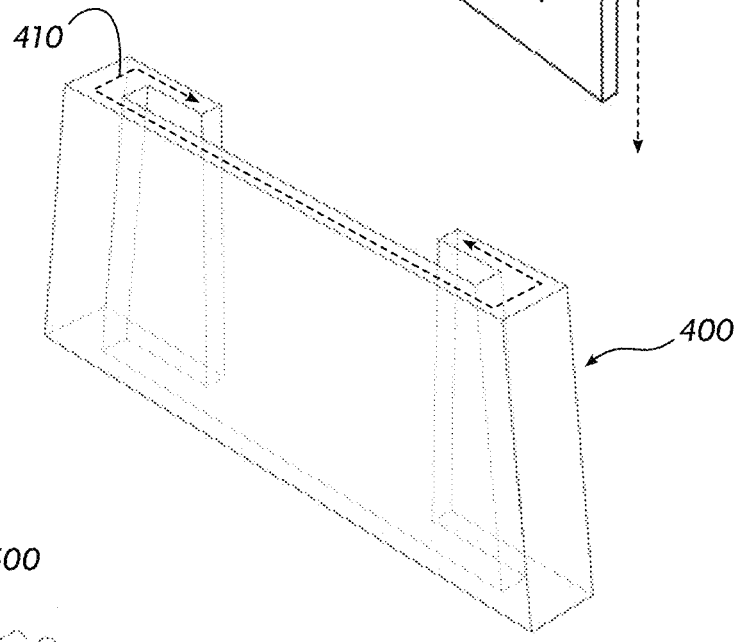
FIG. 4 shows a form-linking component.

FIG. 4 is a form link 400. The link has a C shape 410 and angled interior surfaces which pull two adjacent common forms together securely—refer to FIG. 7.

Figure 5:
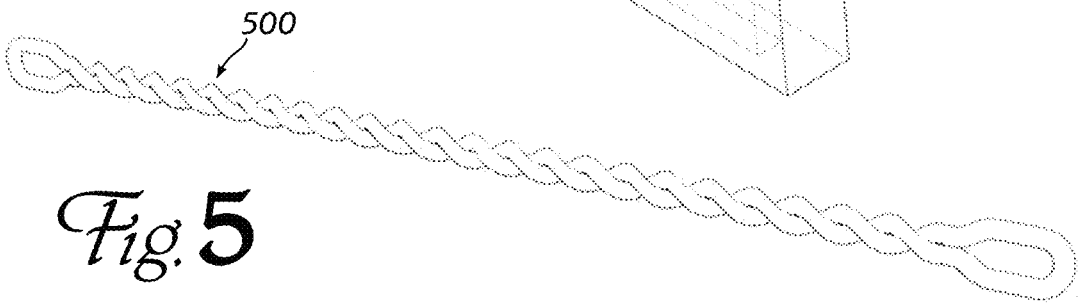
FIG. 5 shows a Gates tie suitable for use in some applications.

FIG. 5 shows a Gates wire tie 500. This is a twisted wire tie having loops on either end. The length of the twisted portion is about the same as the thickness of the required mono-pour.

Returning to FIG. 2, foregoing elements are shown in relation to each other, in a partially-assembled form for casting a foundation wall. Three common forms (300*a*, 300*b*, 300*c*) are arranged back-to-back; the distance between the forms is the desired thickness of the wall. Drill stakes 100*a* and 100*b* are installed against the outer surface of common form 300*a* by using an impact drill or hammer drill to drive the stake into the ground upon which the wall is to be built. Screws, nails or similar fasteners may be inserted through holes in the drill stakes to secure the common form to the stakes.

Endwise-adjacent common forms are linked together by a form link 400 (the form link holding 300*b* to 300*c* is not visible in this view, and the common form that would adjoin 300*a* (whose back would face 300*c*) has been omitted to show internal structures.

Gates wire ties are shown in position at 500*a* and 500*b*. These extend from one common form to a facing common form; the loops extend through slots in each. When the forms are completely assembled, a metal dowel can be inserted through the exposed portions of the wire loops as shown at 230. This dowel prevents the bottom edges of the common forms from separating and spilling the concrete pour. Clips or straps can also be used to hold the common forms together, as shown at 210 and 220. It is appreciated that strap 220 and Gates wire ties 500*a*, 500*b* are cast in place and cannot be removed from the finished wall.

In structures requiring greater strength, steel reinforcing bars ("rebar") may be placed in the area between the common forms. Rebar may be tied or welded together to form a latticework structure.

After the common forms are assembled, secured to each other and to the ground, and after any rebar structure is placed, a concrete slurry is poured into the space between the common forms at around 240. The wet concrete may be agitated with a vibrator or similar to help remove air bubbles and voids and to ensure that the foundation and wall are as dense and strong as possible.

After the concrete cures, stakes 100*a*, 100*b* are removed and cleaned, strap 210 is removed, dowel 230 is removed, and common forms 300*a*-300*c* may be recovered from the wall. Gates ties 500*a*, 500*b* and any straps beneath the wall 220 cannot be removed easily.

Figure 6:
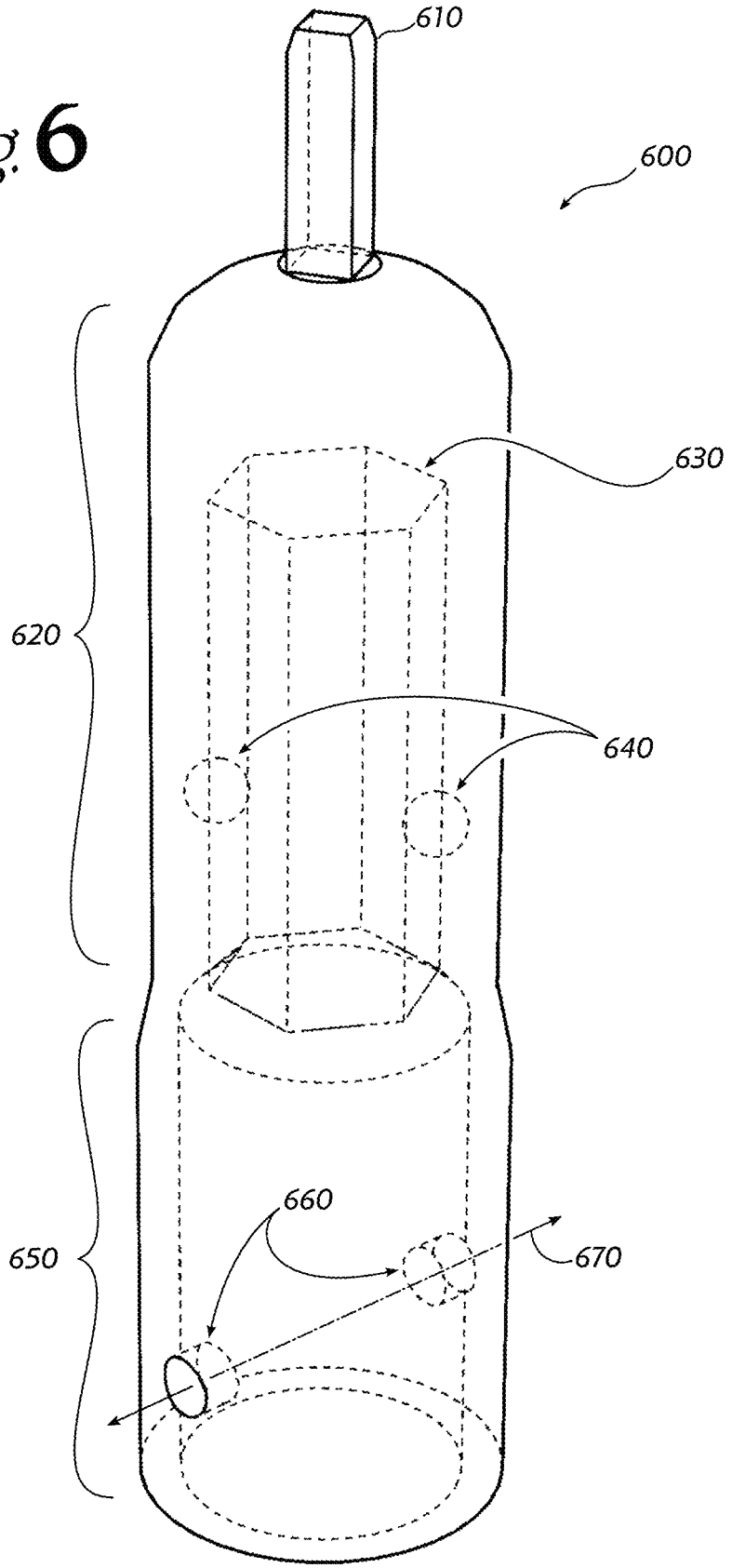
FIG. 6 shows an impact socket suitable for use with an embodiment.

FIG. 6 shows an accessory similar to an impact wrench socket that is used with a drill stake according to an embodiment of the invention. The drive socket 600 has a shank 610 that is suitable for coupling to the chuck or other drive mechanism of an impact drill (hammer drill). A simple square shank is shown here, but advanced impact drills may have specialized chucks; an impact socket according to an embodiment may have a shank specifically adapted to secure to a particular specialized chuck. Two suitable impact-drill chuck/shank forms are known as "SDS-Plus" and "SDS-Max."

Adjacent the shank is a drive socket 620 having an internal void 630 that is shaped to complement the threaded coupler 160 and bolt head 170 of a drill stake. The hexagonal shape shown here will mate with the hexagonal shapes shown in FIG. 1. The drive socket may have one or more spring-loaded balls which are sized and positioned to match divots 165 in the threaded coupler. These may be sufficient to hold the drive socket 600 and the drill stake 100 together while the drill stake is being twisted and pounded into the ground. Stakes would typically be driven at several positions along the outside of forms on both sides of the wall.

Beyond the drive socket portion 620 is a wider skirt 650 that fits over the upper end 130 of the drill stake 100. Through-holes 660 in this portion of the drive socket line up with one of the upper pairs of holes in the drill stake; a pin (e.g., a nail) can be inserted through these holes to positively lock the socket 600 to the drill stake 100. When so locked, an impact hammer or drill can be used in reverse to extract the drill stake from the ground easily.

Figure 7:
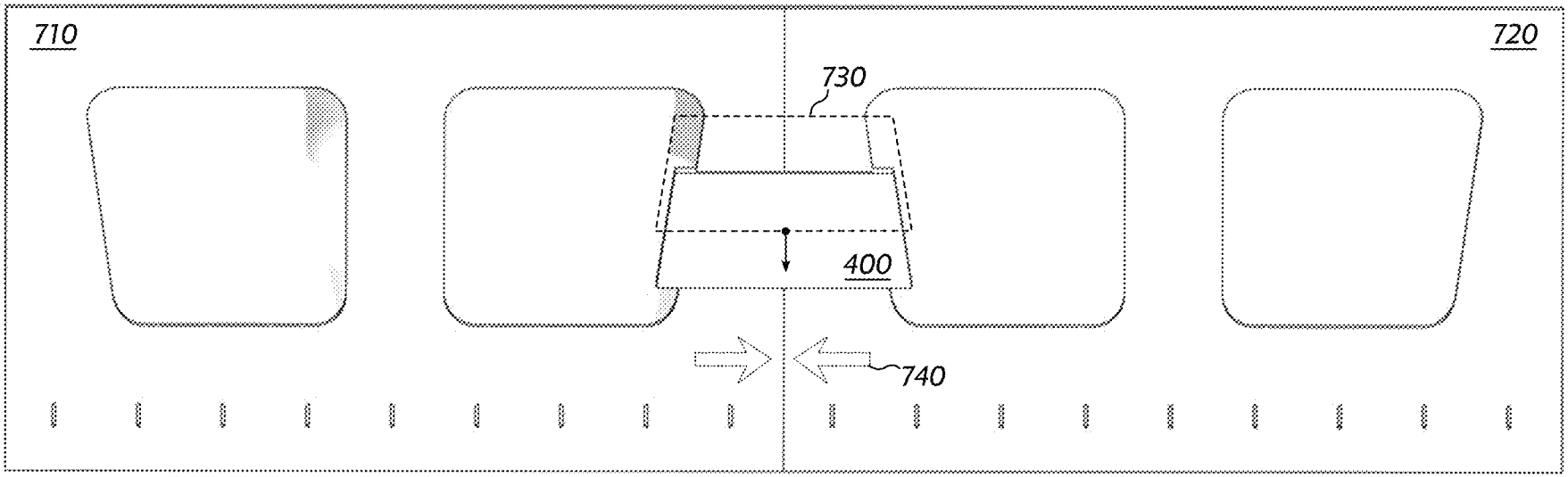
FIG. 7 shows how two common-form segments can be joined together securely using a form-linking component.

FIG. 7 shows how a form link 400 can be used to secure two common forms 710, 720 together end-to-end. The form link is inserted through neighboring windows in the adjacent forms (as indicated at 730) and then slid or hammered down to pull the forms together as shown at 740. This occurs on the outside surface of the forms, while the concrete will be poured against the opposite surface. Thus, the form link and forms can be removed after the concrete has cured.

Figure 8:
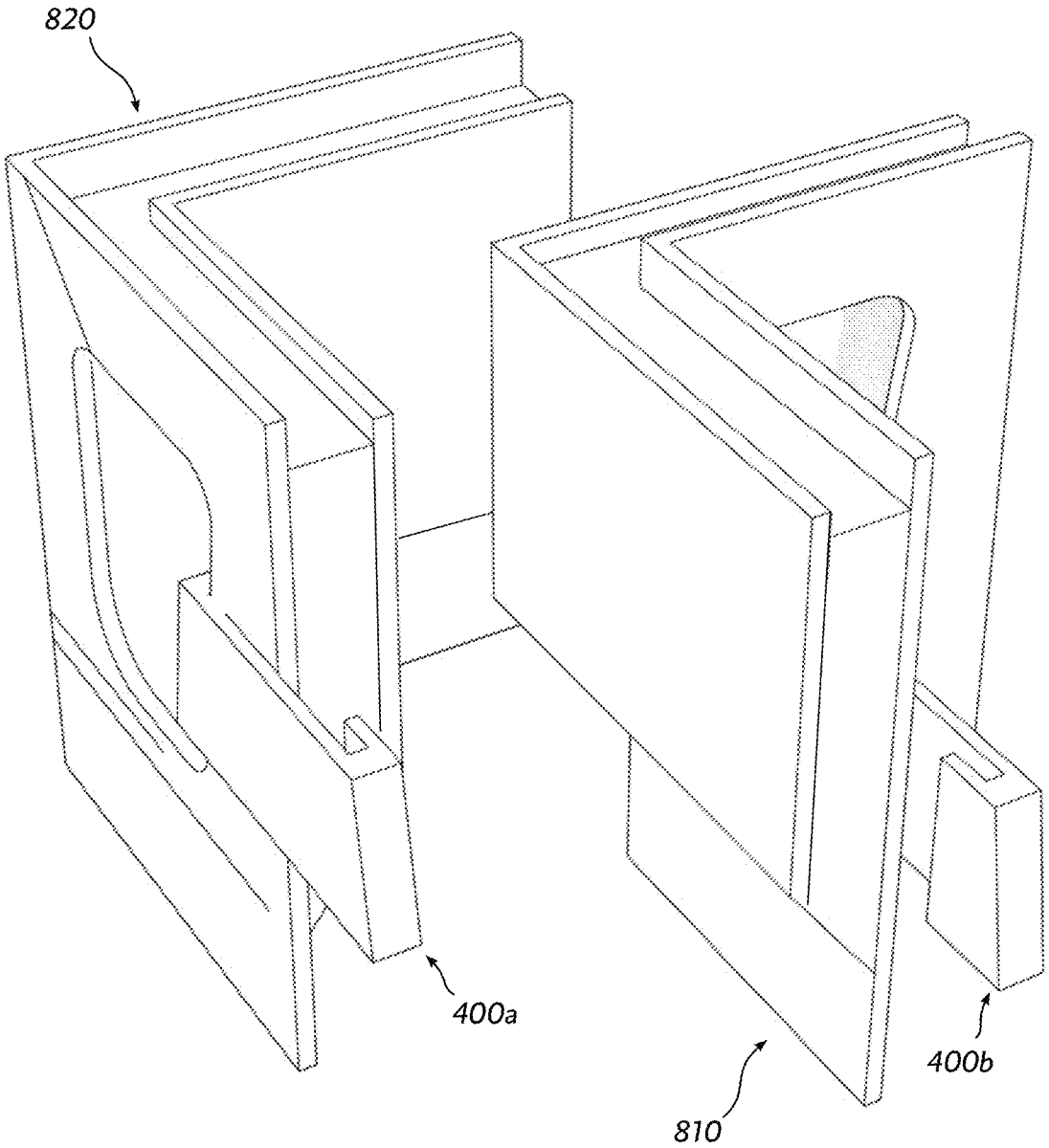
FIG. 8 shows inner- and outer-corner common-form segments that interoperate with an embodiment.

FIG. 8 shows compatible common-form inner- and outer-corner segments 810 and 820, respectively. These forms have windows in the outer surface that can couple to other common-form pieces with form links 400*a*, 400*b*.

Figure 9:
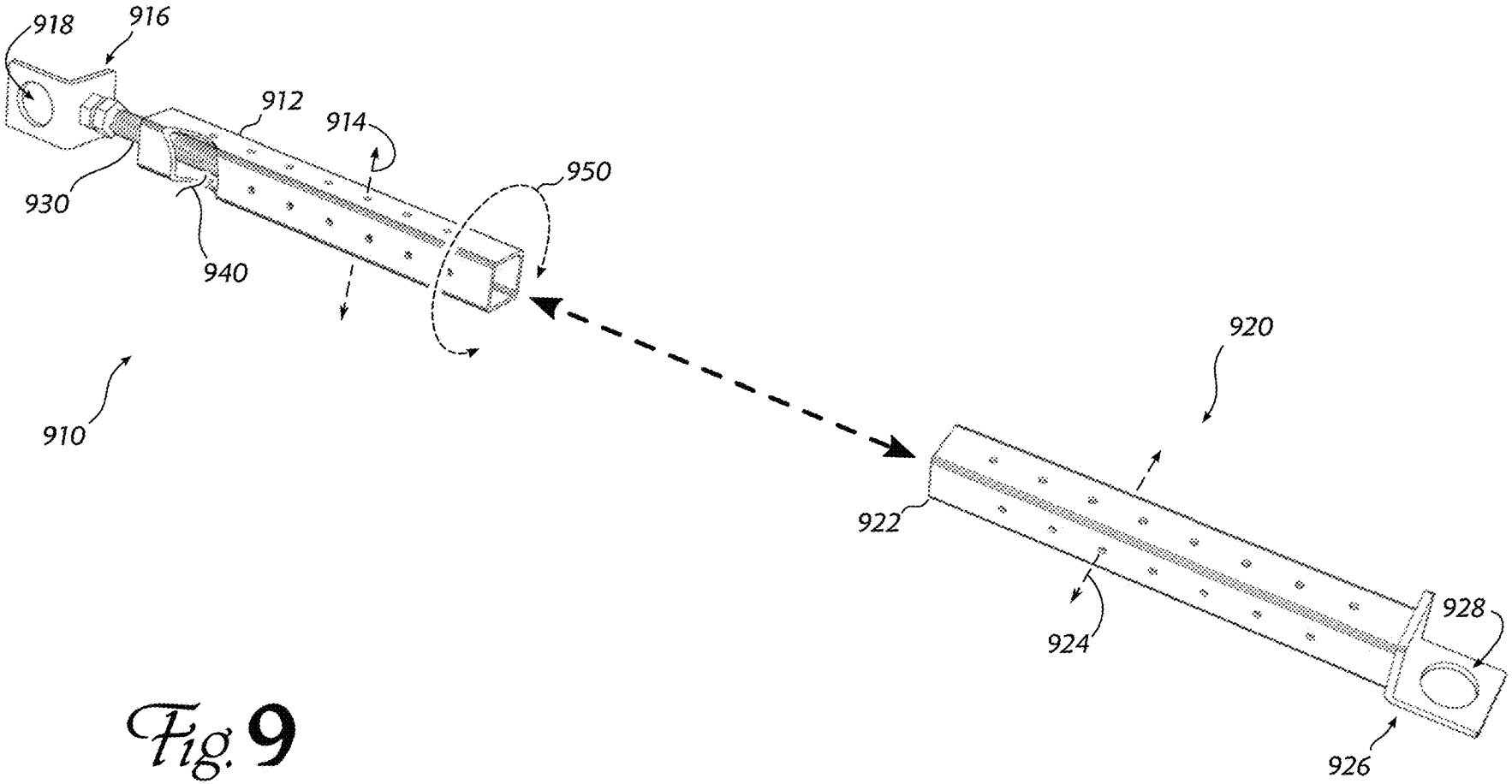
FIG. 9 shows two additional accessories that extend the functionality of an embodiment.
Figure 10:
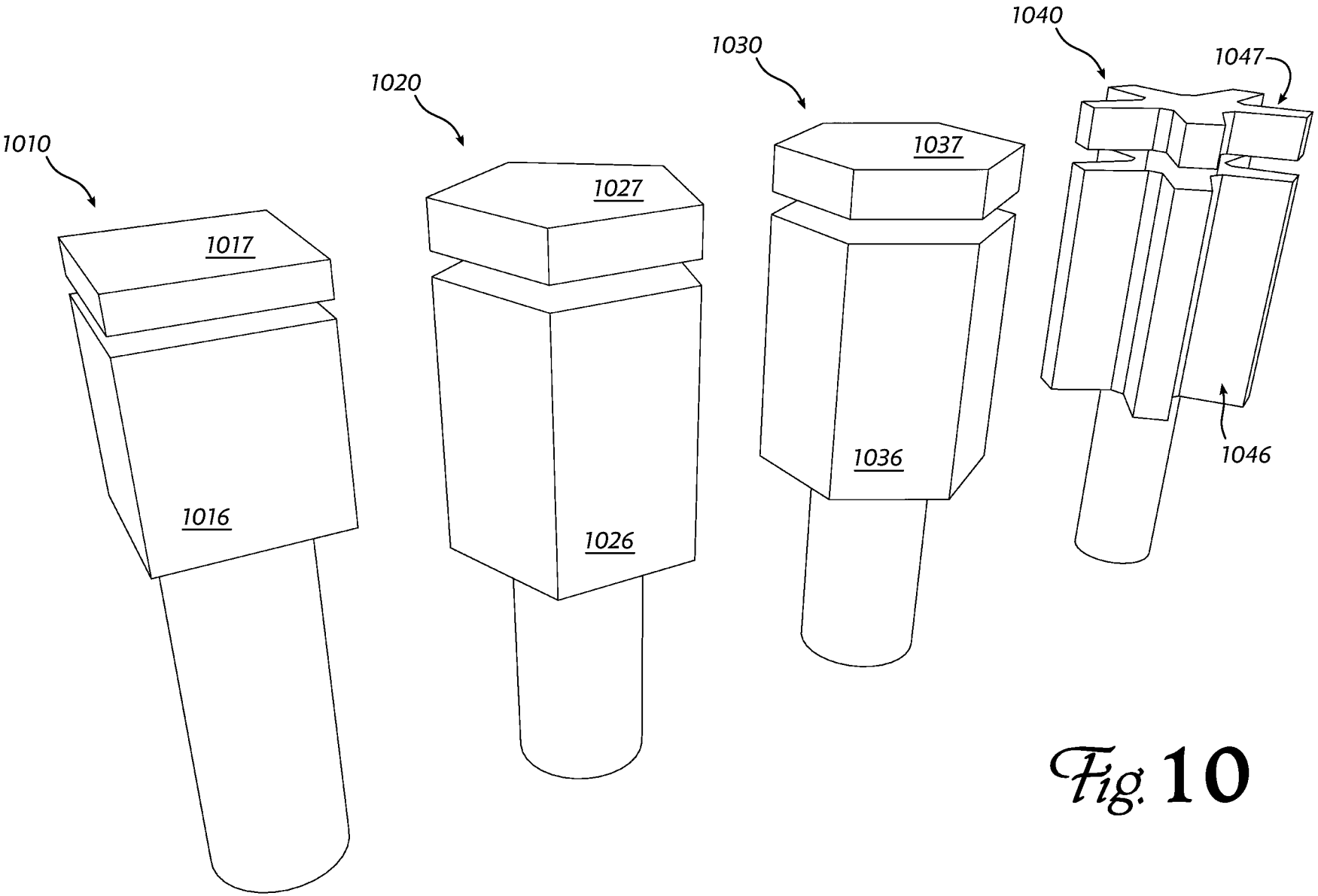
FIG. 10 shows differently-shaped threaded couplers and corresponding threaded bolts.

FIG. 9 shows two additional accessories that may be used with a drill stake according to an embodiment of the invention. The accessories (generally 910, 920) comprise hollow tubing segments 912, 922 (box-profile tubing shown here, but round or other tubing is acceptable). Each segment is drilled at intervals along its length. These holes can accept pins (e.g., nails, at 914, 924) to secure the tubing to corresponding holes along the shaft of a drill stake (e.g., FIG. 1).

Each accessory has an L-shaped bracket at one end (916, 926) and each bracket has a large hole (918, 928). These holes are large enough to permit another drill stake to pass through, even at an angle.

One of the accessories (920) is non-adjustable; it is simply secured to the lower end 120 of a drill stake by way of a pin or nail through corresponding holes.

The other accessory 910 is constructed with a threaded rod 930 extending into the hollow tubing (as shown by cutaway 940). This threaded rod can be screwed into the threaded coupler 160 of a drill stake. Then, by rotating the accessory 910 as shown at 950, the length of the overall assembly (comprising a drill stake, a non-adjustable accessory 910, and an adjustable accessory 920) can be adjusted with good accuracy. If the assembly is placed between two drill stakes (which pass through the holes in the respective brackets), the stakes can be pulled together or pushed apart as needed by rotating the adjustable accessory to screw the threaded rod in or out.

A kit for practicing the invention may comprise an impact socket as shown in FIG. 8 and a plurality of drill stakes as shown in FIG. 1, said plurality of drill stakes including a variety of lengths, such as 2', 3', 4', 5' and 6'. Another kit may also include pairs of accessories as shown in FIG. 9. Kits and expansion sets comprising matched inner and outer-corner common forms, straight (non-corner) common-forms, and a suitable number of form links may also be provided. Straight common-form segments may be mostly of a single length such as 48", but by providing a number of odd lengths (e.g., 24", 36", 42", 46", etc.), forms for casting walls of arbitrary length can be constructed.

The applications of the present invention have been described largely by reference to specific examples and in terms of particular allocations of functionality to certain physical structures. However, those of skill in the art will recognize that the principles of an embodiment can also be achieved by structures that combine the components differently than described herein. Such variations and implementations are understood to be captured according to the following claims.

I claim:

1. A securing stake suitable for setting in compacted earth or gravel surfaces, comprising:

a tubular steel body having a lower end, an upper end, and a plurality of fastener holes along its length, said plurality of fastener holes formed perpendicularly to an axis of the tubular steel body;

a concrete drill structure coupled to the lower end, said concrete drill structure having helical twisted flutes along its length and a plurality of tough cutters at its lower end;

a polygonal prism having a threaded hole therethrough coupled to the upper end, an axis of the threaded hole aligning with an axis of the tubular steel body; and a threaded bolt having a head and a shank, said shank screwed into the threaded hole, wherein the plurality of fastener holes are spaced apart along a length of the tubular steel body, at radially varying angles therethrough, between the polygonal prism and the concrete drill structure.

2. The securing stake of claim 1 wherein the interior of the tubular steel body is accessible through the threaded hole of the polygonal prism when the threaded bolt is removed.

3. The securing stake of claim 1 wherein the tubular steel body is between 2' and 6' in length.

4. The securing stake of claim 1 wherein the tubular steel body is about ¾" in diameter.

5. The securing stake of claim 1 wherein the tubular steel body is Schedule 80 pipe.

6. The securing stake of claim 1 wherein the tubular steel body is steel tubing.

7. The securing stake of claim 1 wherein the concrete drill is smaller in diameter than the tubular steel body.

8. The securing stake of claim 1 wherein the concrete drill is equal in diameter to the tubular steel body.

9. The securing stake of claim 1 wherein the concrete drill is larger in diameter than the tubular steel body.

10. The securing stake of claim 1 wherein the polygonal prism is a hexagonal prism and the head of the threaded bolt is a hexagon.

11. The securing stake of claim 1 wherein the polygonal prism is a pentagonal prism and the head of the threaded bolt is a pentagon.

12. The securing stake of claim 1 wherein the polygonal prism is a square prism and the head of the threaded bolt is a square.

13. The securing stake of claim 1 wherein the polygonal prism is a star-shaped prism and the head of the threaded bolt is a star shape.

14. A kit of components for constructing a form to contain and support poured concrete until the poured concrete sets enough to maintain its shape without support, comprising:

a plurality of drill stakes according to claim 1; and an impact socket adapted to couple to a drill stake of the plurality of drill stakes, said impact socket having a shank suitable for securing to an impact drill.

15. The kit of components of claim 14 wherein the plurality of drill stakes includes a first subset of drill stakes having a first length, and a second subset of drill stakes having a second, different length.

16. The kit of components of claim 14 wherein the shank of the impact socket is an SDS-Plus shank or an SDS-Max shank.

17. The kit of components of claim 14, further comprising:

a fixed accessory comprising a drilled tube coupled to a first L-shaped bracket having a first hole in one face, said drilled tube suitable for securing to one end of a drill stake via a pin through the drilled tube and the one end of the drill stake;

an adjustable accessory comprising a threaded rod suitable for screwing into a threaded coupler at another end of the drill stake, a drilled tube coupled to the threaded rod, and a second L-shaped bracket having a second hole in one face, coupled to the threaded rod, said adjustable accessory adapted to alter a length from the first hole to the second hole by rotating the drilled tube so that the threaded rod enters the threaded coupler by a varying amount.

18. The kit of components of claim 14, further comprising:

a plurality of common wall forms; and a plurality of form links to join the common wall forms end-to-end.

19. The securing stake of claim 1, further comprising:

a metal dowel having a diameter smaller than the shank of the threaded bolt and a length similar to a length of the tubular steel body, wherein the metal dowel is adapted to be inserted into the threaded hole of the polygonal prism and used as a ramrod inside the tubular steel body to break up concrete that has managed to enter the tubular steel body through the plurality of fastener holes.

20. The securing stake of claim 1, further comprising:

a common wall form for holding a concrete slurry in place while it cures, wherein the securing stake is driven into a compacted earthen surface, the common wall form is placed upon the compacted earthen surface and against the securing stake, and at least two fasteners are inserted through two fastener holes of the plurality of fastener holes to secure the stake to the common wall form.

* * * * *